US005636771A

United States Patent [19]

Gordon et al.

[11] Patent Number: 5,636,771

[45] Date of Patent: Jun. 10, 1997

[54] FRANGIBLE POUR SPOUT FITMENT

[75] Inventors: Robert L. Gordon, Monroe; Roderick W. Kalberer, Salisbury Mills, both of N.Y.

[73] Assignee: International Paper Company, Purchase, N.Y.

[21] Appl. No.: 470,409

[22] Filed: Jun. 6, 1995

[51] Int. Cl.[6] ..... B65D 47/10

[52] U.S. Cl. ..... 222/541.5; 222/541.6; 222/541.9; 220/270; 220/276

[58] Field of Search ..... 222/541.1, 541.5, 222/541.6, 541.9; 220/270, 276; 215/47, 48, 50

[56] References Cited

U.S. PATENT DOCUMENTS

| | | | |
|---|---|---|---|
| 2,750,068 | 3/1955 | Platt, Jr. . | |
| 3,128,016 | 4/1964 | Ferri, Jr. . | |
| 3,128,900 | 4/1964 | Chaboche . | |
| 3,199,748 | 8/1965 | Bross . | |
| 3,338,446 | 8/1967 | Faulstich . | |
| 3,608,771 | 9/1971 | Monroe . | |
| 3,998,354 | 12/1976 | Song . | |
| 4,019,663 | 4/1977 | Krautkramer | 222/541.5 X |
| 4,022,357 | 5/1977 | Dwinell | 222/541.9 X |
| 4,356,939 | 11/1982 | Fitte | 222/541.9 |
| 4,986,465 | 1/1991 | Jacobsson . | |
| 5,020,686 | 6/1991 | Dutt . | |
| 5,133,486 | 7/1992 | Moore et al. | 220/270 X |
| 5,145,085 | 9/1992 | Yost . | |
| 5,174,465 | 12/1992 | Luch . | |
| 5,222,530 | 6/1993 | Baker . | |
| 5,249,695 | 10/1993 | Luch . | |
| 5,271,519 | 12/1993 | Adams . | |
| 5,284,188 | 2/1994 | Baker . | |
| 5,295,518 | 3/1994 | Baker . | |
| 5,303,837 | 4/1994 | Adams . | |
| 5,348,183 | 9/1994 | Luch et al. | 222/541.5 X |

*Primary Examiner*—Andres Kashnikow
*Assistant Examiner*—Kenneth Bomberg
*Attorney, Agent, or Firm*—Michael J. Doyle

[57] ABSTRACT

A frangible pour spout construction is improved by the addition of reinforcing webs at the upper plug portion. These webs function to localize the upward pulling force to thereby concentrate the rupture force at the frangible connection between the upper plug and lower pour spout portions. This insures that the pulling force is concentrated so that the frangible connection will rupture prior to the entire fitment being pulled off of the container to which the fitment is secured. The upper plug, later to function as a cap or stopper for the lower spout portion, is provided with a pull ring. The entire construction is die molded, as for example of polyethylene, with the pull ring being molded substantially at 90° from its flat or storage position. A pair of lugs carried by the upper plug holds the pull ring down in its storage position.

6 Claims, 2 Drawing Sheets

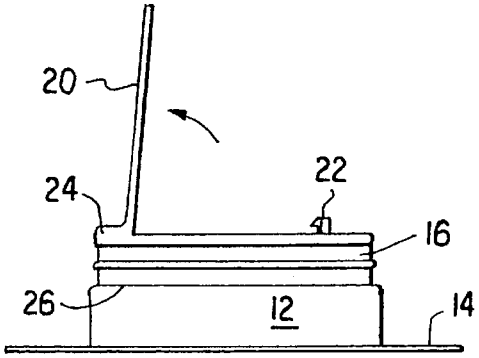
FIG. IB
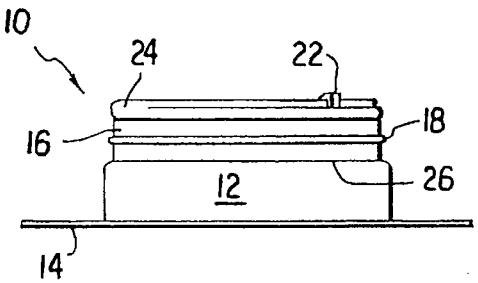
FIG. IA
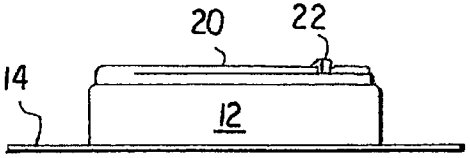
FIG. IE
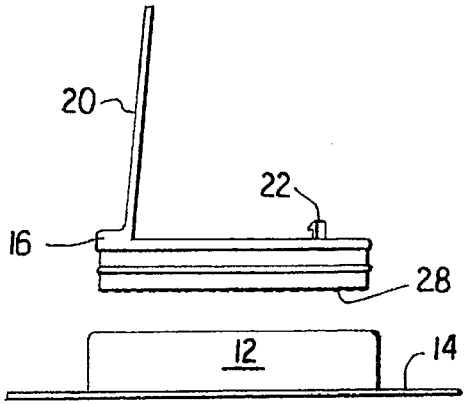
FIG. ID
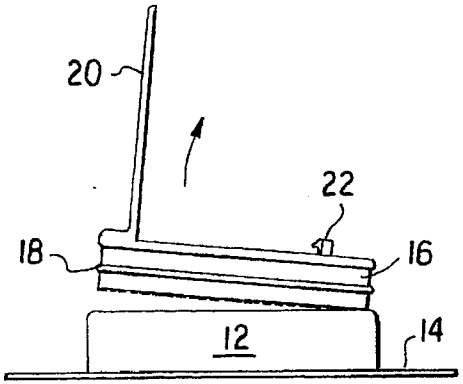
FIG. IC

FRANGIBLE POUR SPOUT FITMENT

BACKGROUND OF THE INVENTION

This invention relates to an integral and frangible pour spout fitment typically fashioned from low density polyethylene or polypropylene. Such fitments are generally provided with a lower flange, the lower surface of which is adapted to be secured to an external wall portion of an apertured container, with the pour fitment being aligned with a pour opening in the container wall or pushed through the opening. Such containers are often formed of paperboard coated on both inside and outside with barrier layers of material which include as an outer layer a plastic such as polyethylene. Such pour spouts and containers are often used in the packaging of potable liquids such as milk and fruit juices. The fitment flange is secured to the exterior or interior portion of the container as by ultrasonic bonding, or by an adhesive, or by passing an electric current through the area of mutual contact to melt and fuse a part of the plastic of the flange with a part of the plastic barrier layer.

Frangible spout or cap opening constructions having two sections which are broken away from each other are known. Examples are seen in U.S. Pat. Nos. 2,750,068 issued to Platt, 4,986,465 issued to Jacobsson, and 5,145,085 issued to Yost. One problem attendant the use of such frangible constructions has been the difficulty of breaking off of one section from the other section due to failure to localize or concentrate the breaking force.

SUMMARY OF THE INVENTION

According to the practice of this invention, a frangible plastic pour spout having upper and lower sections is provided with a reinforcement near the base of a pulling handle, so that upon pulling the handle upwardly to separate the upper from the lower section, the force applied to the frangible connection between the two sections will be localized at the area of the reinforcement, near the base of the handle, to thereby concentrate the force which acts upon and breaks the frangible connection.

BRIEF DESCRIPTION OF THE DRAWINGS

FIG. 1A is a side elevational view of the frangible pour spout of this invention.

FIG. 1B is a view similar to FIG. 1A showing the pull handle in an upper or pulling position.

FIG. 1C illustrates a partial breaking of the top section from the lower section upon upward pulling of the handle.

FIG. 1D shows the upper section completely separated from the lower section.

FIG. 1E shows the lower section repositioned so as to releasably and telescopingly fit inside of the lower section.

DETAILED DESCRIPTION OF THE INVENTION

Figure 2:
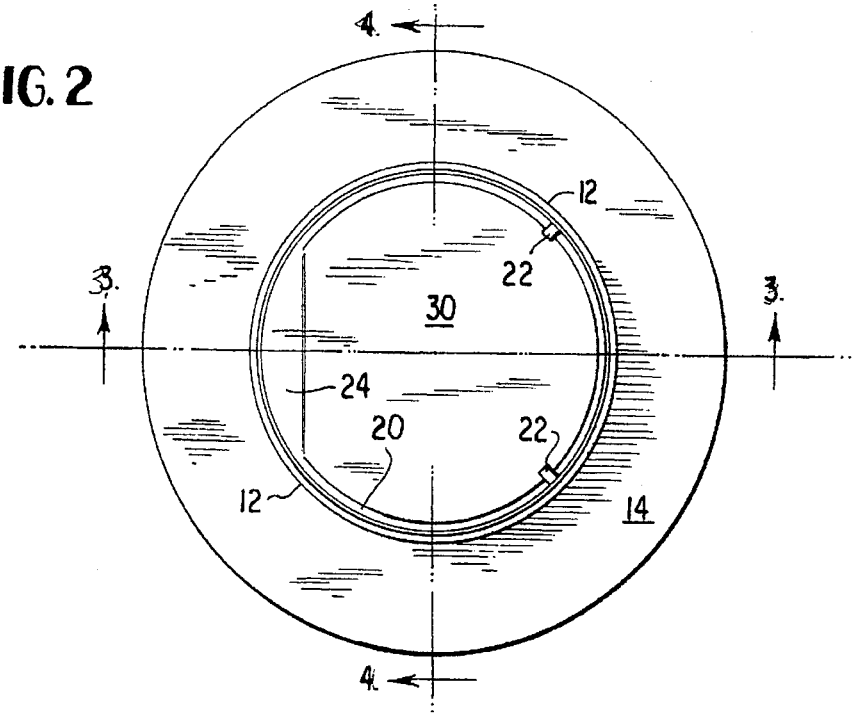
FIG. 2 is a plan view of the frangible pour spout fitment of this invention.

Referring now to FIGS. 1A through 1E, the frangible pour spout fitment is denoted generally as 10, includes a lower section having an annular vertical wall 12 and an integral lower flange 14. Wall 12 defines a lumen or pour opening. The upper portion of the fitment is in the form of a hollow plug and has an annular wall designated as 16, the latter having a continuous annular rib 18 on its outer surface. A pull ring 20, of approximately 320° annular extent, is normally held down to a latched or horizontal position by a pair of lugs or hooks 22. The ends of pull ring 20 are secured to region or zone 24 of the upper spout plug, this region being shown also at FIG. 2. A frangible flashing is designated as 26 and joins the lower periphery of the upper spout plug wall 16 to the upper periphery of the lower spout wall 12. Flashing 26 is a very thin connecting ring integral with walls 12 and 16.

Referring to FIG. 1B, pull ring 20 has now been released from beneath retaining lugs 22 by distorting it radially inwardly and is in an up position ready for pulling by the consumer. At FIG. 1C, the flashing 26 has been broken in the area directly beneath region 24, and the upper plug is partially removed from the lower spout portion. FIG. 1D shows the upper and lower spout portions fully separated. The remnants of flashing 26 are designated as 28. FIG. 1E shows the upper spout portion or plug reinserted into the lower spout portion after a partial dispensing of the container which carries the fitment.

Referring now to FIG. 2 of the drawings, the extent and location of zone or region 24 is shown, together with the location of two resilient retaining lugs or hooks 22. Flange 14 is shown as completely annular.

Figure 3:
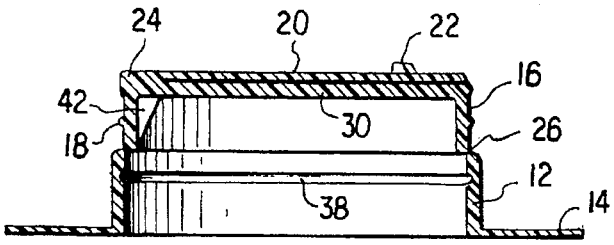
FIG. 3 is a view taken along Section 3—3 of FIG. 2.
Figure 4:
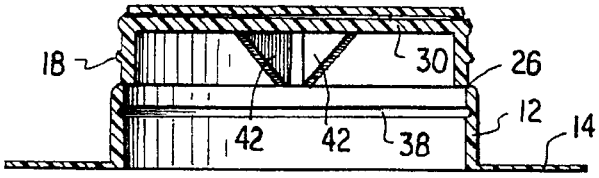
FIG. 4 is a view taken along Section 4—4 of FIG. 2.

FIG. 3 is essentially a transverse section of FIG. 1A and further illustrates flashing 26 as frangibly connecting the upper and lower pour spout elements. As shown also at FIG. 4, a pair of generally triangular and integral webs 42 are located in an area below zone 24. Reinforcing webs 42 function to localize the upward pulling force on frangible flashing 26. When ring 20 is pulled upwardly, as shown in FIGS. 1B and 1C, there is a tendency for the entire upward force to be distributed around the entire circumference of upper plug wall 16, as viewed at FIG. 2. By the addition or introduction of reinforcements 42, the pulling force is concentrated at their location. This tends to ensure that ripping or tearing of frangible flashing 26 will commence at a location near and just below reinforcement webs 42. By concentrating the upward pulling force to this area, flashing 26 will always rupture prior to the upward pulling force, if sufficient, pulling the entire fitment off of the container.

Reinforcements 42 extend from the lower surface of plug top wall 30 to a region of the innermost surface of plug side wall 16 and are generally triangular. Their respective planes are at an angle with respect to each other. One or more may be employed, the two illustrated being exemplary.

Figure 5:
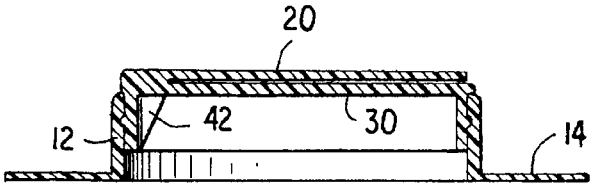
FIG. 5 is a transverse sectional view showing the upper section or hollow plug telescopically and releasably received within the lower section.

FIG. 5 illustrates the reclosed configuration of the fitment. With flashing 26 having been broken, the upper plug is now able to be pushed downwardly so that rib 18 resiliently engages groove 38, the latter located in the interior surface of wall 12. When the consumer desires to dispense another portion of the contents of the container to which the fitment is secured, it is only necessary to again dislodge pull ring 20 from beneath lugs 22 and pull the ring upwardly, as indicated at FIGS. 1B and FIG. 1C to remove the upper plug from the pour spout. The outer diameter of plug wall 16 is slightly less than the inner diameter of wall 12 to thus permit the plug to be inserted into the lower pour spout 12,14.

Lugs or hooks 22 are positioned so that they face toward the center of the upper plug, this permitting distortion of pull ring 20 in a radially inward direction for disengagement with the lugs.

An important aspect of this invention is that the fitment is molded as an integral piece in a mold die or cavity, with pull ring 20 being molded generally in the up position shown at FIGS. 1B and 1C. Thus, upon disengagement of pull ring 20 from lugs 22, there will be a bias tending to rotate the pull ring counterclockwise from its storage or horizontal position to facilitate its grasping by the consumer.

Further, while shown as circular and bendable, pull handle 20 may assume other forms. No matter what form the pull handle assumes, reinforcements 42 are located near the connection between the pull handle and the upper plug so as to concentrate the flashing rupture force at one location along flashing 26 instead of the force being distributed therealong which would occur without the reinforcements.

Another important aspect of the design is that there are no protrusions or extensions around the circumference of the spout. This insures that a sonic sealing tool can fit over the spout/cap portion and come into full contact with the flange.

We claim:

1. A frangible pour spout including a flanged lower section, said flanged lower section including an annular pour lumen having an internal surface, an upper section, said upper section being in the general form of a hollow plug having an annular side wall with an internal surface and a top closure wall with a lower surface, an integral pull handle joined to one peripheral region of said top closure wall, an integral reinforcement between said plug side wall internal surface and said lower surface proximate said one peripheral region, a lowermost portion of said plug frangibly secured by flashing to an uppermost portion of said flanged lower section, whereby upon pulling said pull handle, the pulling force will be applied to said frangible flashing primarily at the location of said integral reinforcement.

2. The pour spout construction of claim 1 wherein said handle is distortable and is substantially circular.

3. The pour spout construction of claim 1 wherein said flanged lower section includes a circular groove and said annular side wall of said hollow plug includes a circular rib.

4. The pour spout construction of claim 1 wherein said integral reinforcement is defined by two generally triangular webs.

5. The pour spout construction of claim 1 including a latching lug integral with said plug top closure wall, said latching lug extending upwardly and normally engaging a portion of said integral pull handle, said integral pull handle normally biased to an upwardly extending position.

6. The pour spout construction of claim 1 wherein said lower section internal surface has a groove therein and said flange is integral and annular, said plug annular side wall having a rib projecting radially outwardly therefrom, said rib being complementary in shape to said groove, an outer diameter of said plug being smaller than a diameter of said pour lumen, whereby said plug can be releasably inserted into said pour lumen after said flashing has been ruptured.

* * * * *